US010196929B2

(12) United States Patent
Mantkowski et al.

(10) Patent No.: US 10,196,929 B2
(45) Date of Patent: Feb. 5, 2019

(54) PROCESS FOR DEPOSITING A CERAMIC COATING AND PRODUCT FORMED THEREOF

(71) Applicant: General Electric Company, Schenectady, NY (US)

(72) Inventors: Thomas Edward Mantkowski, Madeira, OH (US); Raymond William Heidorn, Fairfield, OH (US); Nripendra Nath Das, West Chester, OH (US); Anthony Wayne Reynolds, Burlington, KY (US)

(73) Assignee: General Electric Company, Schenectady, NY (US)

( * ) Notice: Subject to any disclaimer, the term of this patent is extended or adjusted under 35 U.S.C. 154(b) by 532 days.

(21) Appl. No.: 13/771,400

(22) Filed: Feb. 20, 2013

(65) Prior Publication Data

US 2015/0140284 A1 May 21, 2015

Related U.S. Application Data

(60) Provisional application No. 61/666,834, filed on Jun. 30, 2012.

(51) Int. Cl.

| | |
|---|---|
| ***C23C 4/18*** | (2006.01) |
| ***C23C 4/134*** | (2016.01) |
| ***C23C 4/00*** | (2016.01) |
| ***F01D 25/00*** | (2006.01) |
| ***F01D 9/02*** | (2006.01) |

(52) U.S. Cl.

CPC ..... *F01D 25/005* (2013.01); *C23C 4/134* (2016.01); *C23C 4/18* (2013.01); *F01D 9/02* (2013.01); *F05D 2230/90* (2013.01); *Y10T 428/24802* (2015.01)

(58) Field of Classification Search

CPC .. C23C 4/127; C23C 4/18; C23C 4/00; C23C 4/01; C23C 4/04; C23C 4/06; C23C 4/067; C23C 4/073; C23C 4/08; C23C 4/10; C23C 4/11; C23C 4/12; C23C 4/123; C23C 4/126; C23C 4/129; C23C 4/131; C23C 4/134; C23C 4/137

USPC ..... 427/232, 235

See application file for complete search history.

(56) References Cited

U.S. PATENT DOCUMENTS

| | | | | |
|---|---|---|---|---|
| 5,723,078 | A | 3/1998 | Nagaraj et al. | |
| 6,132,520 | A | 10/2000 | Schilbe et al. | |
| 8,262,802 | B2 | 9/2012 | Garry et al. | |
| 2005/0059321 | A1* | 3/2005 | Bublath et al. | 451/2 |
| 2009/0074588 | A1* | 3/2009 | Scott | 416/96 R |
| 2009/0226626 | A1* | 9/2009 | Gupta et al. | 427/448 |
| 2010/0254820 | A1 | 10/2010 | Maly et al. | |

* cited by examiner

*Primary Examiner* — Dah-Wei D. Yuan
*Assistant Examiner* — Nga Leung V Law
(74) *Attorney, Agent, or Firm* — General Electric Company; Brian Overbeck

(57) ABSTRACT

A system and methods for applying a ceramic coating to a component that includes first applying a coating material to a first portion of a component. A removal agent is then applied to a second portion of the component that has an overspray byproduct thereon, and then the ceramic coating material is applied to at least the second portion of the component.

8 Claims, 6 Drawing Sheets

PROCESS FOR DEPOSITING A CERAMIC COATING AND PRODUCT FORMED THEREOF

CROSS REFERENCE TO RELATED APPLICATIONS

This application claims the benefit of U.S. Provisional Application No. 61/666,834, filed Jun. 30, 2012, the contents of which are incorporated herein by reference.

BACKGROUND OF THE INVENTION

The present invention generally relates to coatings capable of use on components exposed to high temperatures, such as the hostile thermal environment of a gas turbine engine. More particularly, this invention is directed to methods and a system for applying a thermal barrier coating (TBC) with improved erosion resistance by intermediately removing overspray byproduct that accumulates during the application process.

The use of thermal barrier coatings (TBCs) on components such as combustors, high pressure turbine (HPT) blades, vanes and shrouds is increasing in commercial as well as military gas turbine engines. The thermal insulation provided by a TBC enables such components to survive higher operating temperatures, increases component durability, and improves engine reliability. TBCs are typically formed of a ceramic material and deposited on an environmentally-protective bond coat to form what is termed a TBC system. Bond coats are typically formed of an oxidation-resistant diffusion coating such as diffusion aluminide, platinum aluminide or an oxidation-resistant overlay coating such as MCrAlY (where M is iron, cobalt and/or nickel).

Various processes can be used to deposit TBC materials, including thermal spray processes such as air plasma spraying (APS), vacuum plasma spraying (VPS), low pressure plasma spraying (LPPS), and suspension plasma spraying (SPS). However, these spray processes may experience problems with overspray wherein the TBC materials are deposited on undesired surfaces of the coated component to form what is hereinafter referred to as an overspray byproduct. The overspray byproduct is only loosely adherent and is highly undesirable from the viewpoint of mechanical robustness, erosion resistance and thermal spalling resistance. This problem can be observed in SPS processes that use a feedstock comprising fine particles suspended in a liquid agent. The suspension is fed to a plasma spray torch in a controlled manner and injected into the plasma plume for deposition onto a substrate. The particles typically, but not necessarily, have a median diameter in the range about 0.4 micrometers to about 2 micrometers, which may be significantly smaller than powder media typically used with other conventional thermal spray processes. The liquid agent typically is a solution of water, alcohol, or similar solvent mixed with an additive, for example, ethanol at about 10 percent by weight, using polyethyleneimine as a dispersant (at 0.2 percent by weight of the solids). In a typical SPS process, the plasma spray torch motion and spraying routine are traditionally programmed to provide the desired thickness distribution in the resultant coating without regard for overspray byproduct build up.

A vane segment 10 of a gas turbine engine is represented in FIG. 1 for purposes of the following discussion. The segment 10 comprises several airfoils 12 connected to outer and inner bands 14 and 16. When SPS is performed on, for example, one of the airfoils 12, the byproduct accumulates on the surfaces of the inner and outer bands 16 and 14 and the fillets where the airfoil 12 is joined to the bands 14 and 16. If the entire segment 10 sprayed in one uninterrupted program, as is a common procedure, the overspray byproduct is subsequently entrapped by the sprayed coating intentionally deposited on the bands 14 and 16. It has been determined that the entrapped overspray byproduct results in a softer region of the coating that may have lower erosion resistance and be prone to spallation. The decreased erosion resistance and greater susceptibility to thermal spalling are attributed to the inadequate adherence and non-uniform thickness of the overspray byproduct.

As further explanation, an SPS process is represented in FIGS. 2 through 5. FIG. 2 schematically represents an uncoated vane segment 10 viewed from a side. In FIG. 3, an SPS plasma spray torch 18 is represented as spraying ceramic material onto the segment 10 to deposit a TBC coating 20 on portions of the outer band 14 and airfoil 12. During spraying, overspray byproduct 22 accumulates over a portion of the inner band 16 and an adjacent portion of the airfoil 12. In FIG. 4, the SPS process is continued as ceramic material is deposited to form the coating 20 on portions of the inner band 16 and airfoil 12, including the overspray byproduct 22. Finally, in FIG. 5, the ceramic material is sprayed onto remaining portions of the airfoil 12 of the segment 10. The resulting coated segment 10 may be prone to erosion and spalling in the region of the coating 20 where the overspray byproduct 22 was deposited for the reasons described above. It should be understood that the overspray byproduct 22 can accumulate not only on the regions that have not seen any TBC deposit but also in regions on top of the TBC 20 that was already deposited. The layer of overspray byproduct 22, which is often much thinner than TBC 20, on top of an already accomplished TBC 20 is not shown in any of the figures.

In previous methods of TBC deposition, the overspray byproduct 22 is either tolerated or regions prone to overspray byproduct 22 were covered prior to the spraying process with a material such as a barrier tape, cover, or mask. Continuing the deposition process while retaining the overspray by product reduces the robustness of the TBC 20. While covering the overspray-affected regions prior to the spraying process can be an effective method of avoiding the problem, it can be difficult to efficiently implement such a method into a continuous fabrication process. Another disadvantage is that it is difficult to select materials that can be utilized for purposes of covering the potential overspray regions which also have thermal stability at the temperatures involved in the thermal spray processes.

Accordingly, there is a need for a method of applying TBCs to components that is capable of avoiding or limiting the problems associated with overspray byproduct buildup. A need exists to remove the byproduct in such a way that the process lends itself to an efficient continuous coating operation resulting in increased throughput.

BRIEF DESCRIPTION OF THE INVENTION

The present invention provides methods and a system for applying a ceramic coating, for example, a thermal barrier coating (TBC), that entails intermediately removing overspray byproduct that accumulates during the application process.

According to a first aspect of the invention, a method includes depositing a ceramic coating on a first portion of a component and unintentionally depositing an overspray byproduct on a second portion of the component. A removal agent is then applied to the second portion of the component to remove overspray byproduct thereon, after which the ceramic coating is deposited onto at least the second portion of the component. According to a preferred aspect of the invention, the coating is deposited using a suspension plasma spray technique, and the removal agent is dry ice that is sprayed onto the second portion of the component.

According to a second aspect of the invention, a system is provided that includes a suspension plasma spraying apparatus configured to deposit a ceramic coating onto a first portion of a component and means for applying a removal agent to a second portion of the component that has an overspray byproduct thereon.

A third aspect of the invention is the fabrication of a structural component that has a thermal barrier coating deposited using a suspension plasma spraying process and intermittently removing the overspray byproduct by using a removal agent, leading to the advantage that the structural component has superior properties relative to components wherein the overspray byproduct is not removed.

A technical effect of the invention is that an overspray byproduct can be removed from a surface prior to depositing a coating layer thereon, and thereby prevent or at least reduce problems associated with overspray byproduct build up.

Another technical effect of the invention is that a structural component with superior erosion resistance and thermal spalling resistance is produced by depositing a thermal barrier coating using a suspension plasma spraying process that includes intermittent removal of overspray byproduct.

Other aspects and advantages of this invention will be further appreciated from the following detailed description.

DETAILED DESCRIPTION OF THE INVENTION

Figure 4:
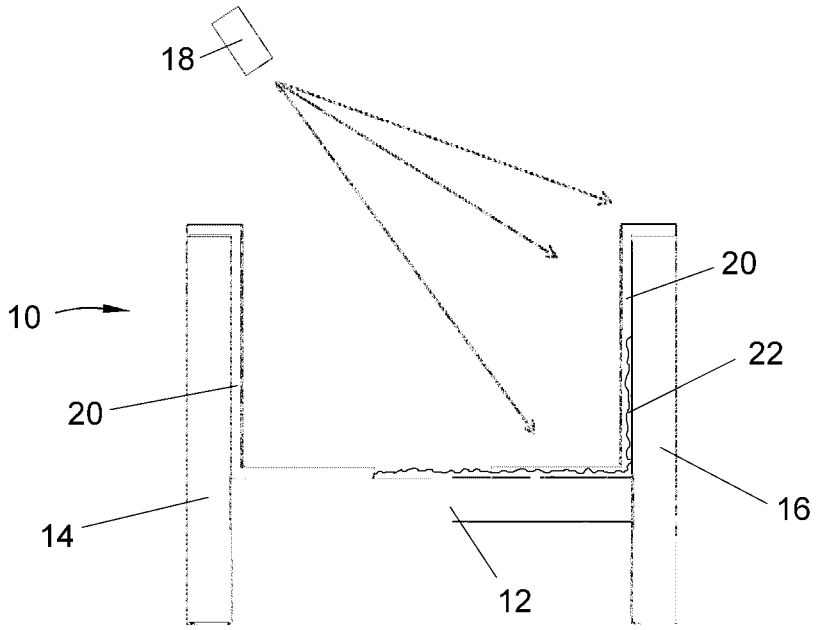
FIG. 4 (Prior Art)
Figure 5:
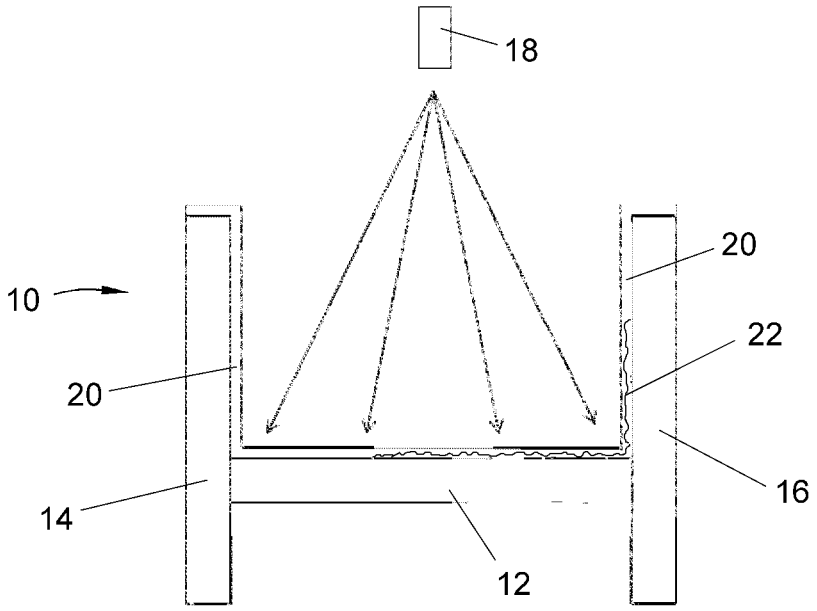
FIG. 5 (Prior Art)

In a conventional spray process, a plasma gun motion is programmed to provide the desired thickness distribution in the resultant coating without regard to overspray build-up. In the case of an SPS process performed on vanes of a gas turbine engine (or other turbomachine), the inner and outer bands and fillets of the vane act to hold the overspray and cause it to get entrapped in the sprayed coating. By segmenting the spray program and coating only a section of the vane at a time, and then removing the overspray, the performance of the coating can be dramatically improved. FIGS. 6 through 11 schematically represent a method of depositing a TBC 20 in accordance with an embodiment of the present invention. In this process, the spray routine and manipulation of the plasma spray torch 18 are arranged in a fashion similar to those represented in FIGS. 3 through 5. While the spray routine and plasma spray torch arrangement are shown for purposes of illustrating preferred aspects of the present invention, it is foreseeable that functionally-equivalent structures, arrangements, and routines could be used. Such alternatives may include a spray routine that coats parts of a component in a different order, a different type of spraying apparatus, such as a VPS-based apparatus, or a different type of component to be coated. Such functionally-equivalent alternatives are within the scope of the present invention.

Figure 3:
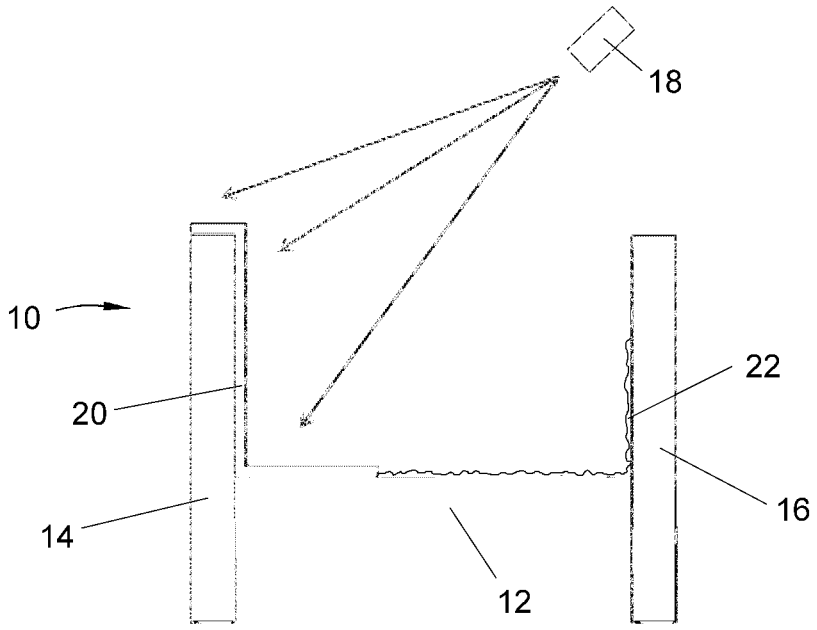
FIG. 3 (Prior Art)
FIGS. 3 through 5 schematically represent steps of a conventional SPS process being performed on the segment of FIG. 2.
Figure 6:
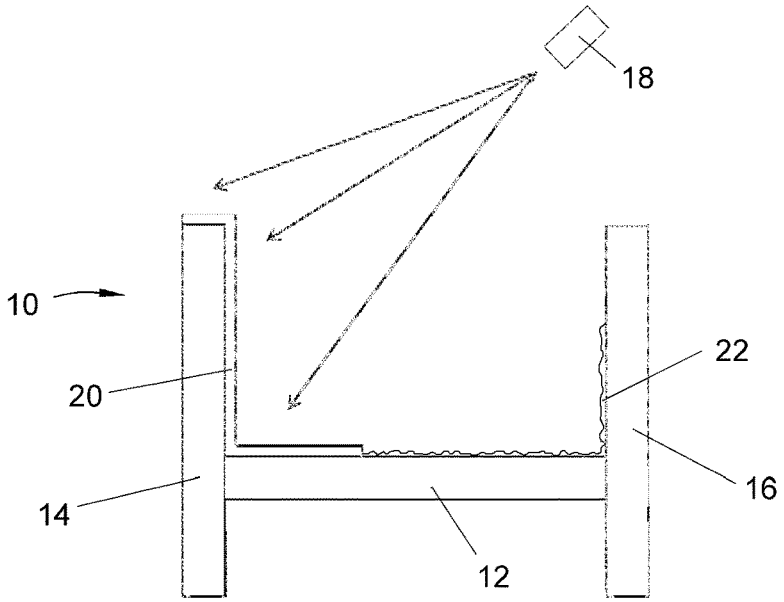
FIGS. 6 through 11 schematically represent steps of an SPS process that includes intermediate overspray byproduct removal operations in accordance with a preferred embodiment of the present invention.
Figure 7:
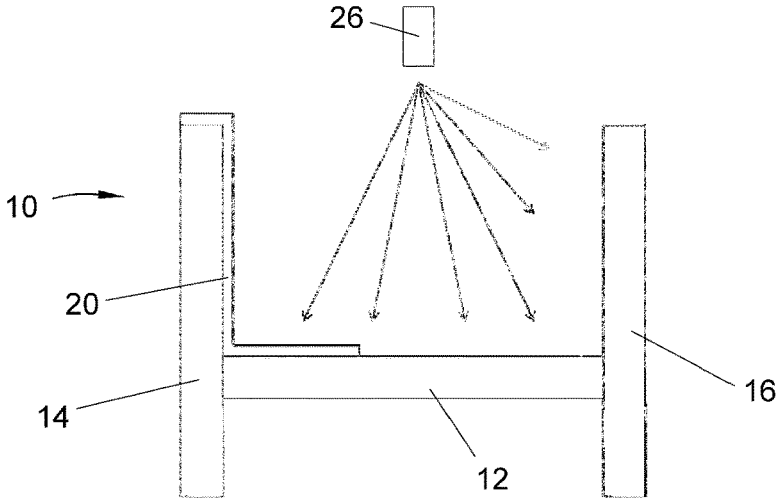

FIG. 6 represents a vane segment 10 undergoing an SPS process similar to that shown in FIG. 3. FIG. 6 is identical to FIG. 3 except that FIG. 6 is intended to represent the beginning of a process where several elements of the present invention are utilized. The SPS process is performed by a system comprising the SPS plasma spraying torch 18 and a removal apparatus 26 shown in FIG. 7. In FIG. 6, the torch 18 is represented as depositing a ceramic material onto a surface of the segment 10, including portions of its outer band 14 and airfoil 12. During the SPS process, the spray routine and plasma spraying torch manipulation are performed in a fashion to select the area to be sprayed and hence the potential areas where an undesirable overspray byproduct 22 can form. Selecting the areas to be sprayed by manipulation of the spray routine and the spray torch manipulation aids in selecting areas of the undesirable overspray byproduct 22 typically produced as a byproduct of the operation in order for easier removal in later steps. Upon completion of this step of the SPS process, the airfoil 12 and outer band 14 are coated with the desired TBC 20. However, the overspray byproduct 22 has been deposited on a second region of the segment 10 outside of the desired area. The region on which the overspray byproduct 22 has been deposited is represented in FIG. 6 as including a portion of the inner band 16 and an adjacent portion of the airfoil 12. As described above and represented in FIGS. 3 through 5, if the SPS process was continued without removal of the overspray byproduct 22, the surface regions of the airfoil 12 and inner band 16 coated with the overspray byproduct 22 may be prone to erosion and possibly spalling due to loose adherence and non-uniform thickness of the overspray byproduct 22. In order to avoid or at least reduce this concern, FIG. 7 represents the removal apparatus 26 as performing a removal operation on the segment 10, to remove the overspray byproduct 22. The removal apparatus 26 removes the overspray byproduct 22 by applying a removal agent to the segment 10, thereby re-exposing the original surfaces of the airfoil 12 and inner band 16. Preferably, the removal agent is dry ice entrained in compressed air and is propelled by the removal apparatus 26, more preferably effectively blasting the overspray byproduct 22 with the dry ice. The removal apparatus 26 propels the dry ice at a pressure that provides enough impact to remove the undesirable overspray byproduct 22, but that is not abrasive enough to remove or damage the desirable TBC 20, or any metallic bond coat on the surfaces of the airfoil 12 and inner band 16. As such, the dry ice blast may overlap the edge of the TBC 20 to ensure that as much overspray byproduct 22 is removed as possible.

Figure 8:
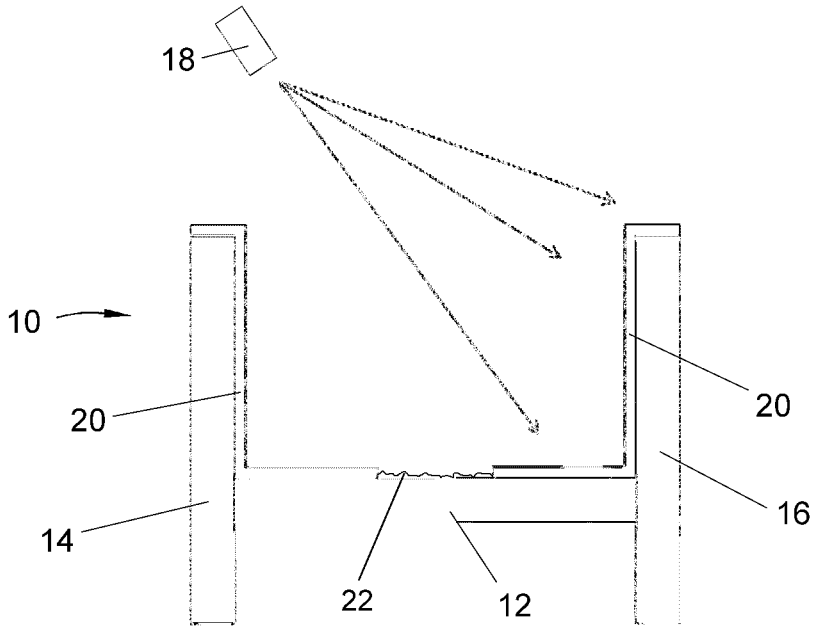
Figure 9:
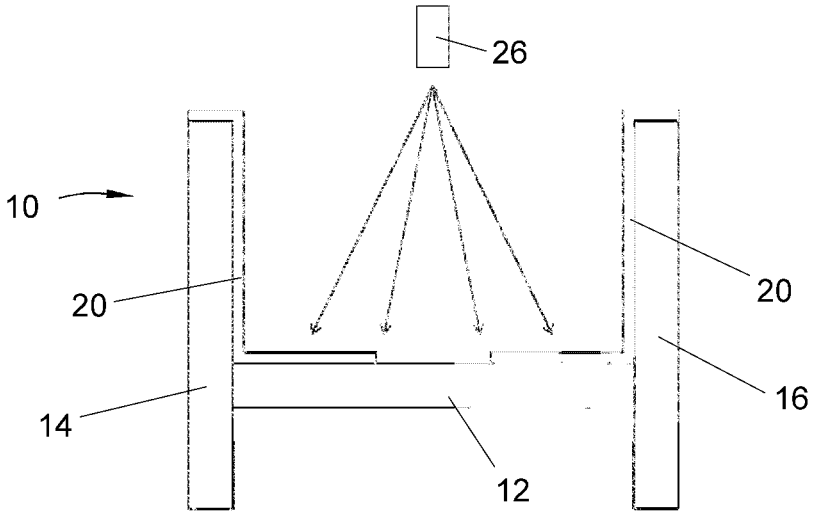

In FIG. 8, portions of the inner band 16 and the airfoil 12 of the segment 10 are being coated with ceramic material to produce a second region of the desired TBC 20. Thereafter, the segment 10 is subjected to another overspray removal treatment using dry ice. The removal apparatus 26 is represented in FIG. 9 as blasting dry ice over the airfoil 12 that again overlaps portions of the TBC 20 to ensure maximum removal of overspray byproduct 22 on the airfoil 12 and outer band 14.

Figure 10:
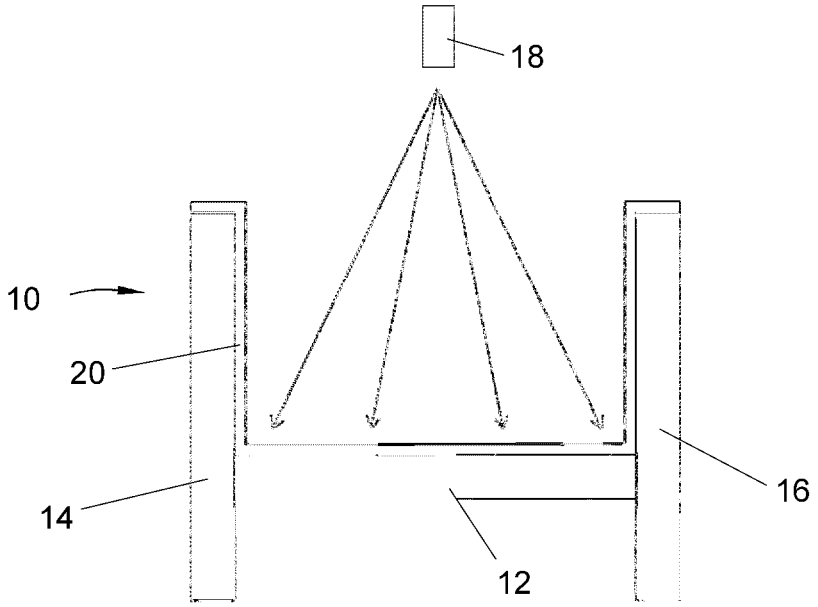
Figure 11:
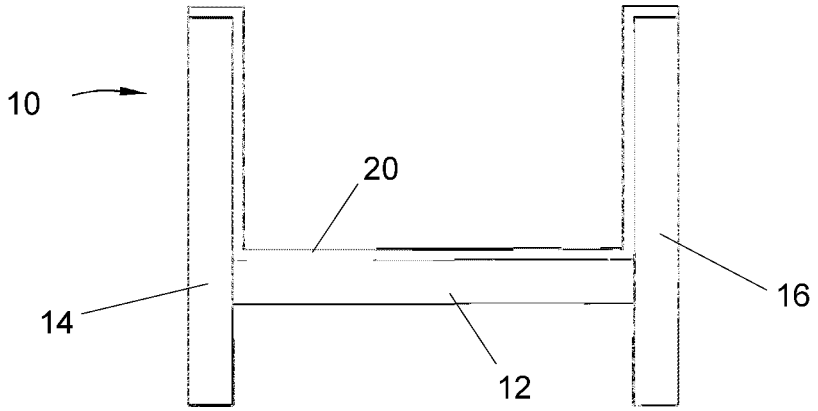

FIG. 10 represents the third, and in some cases, a final stage of the SPS process wherein the SPS plasma spraying torch 18 sprays ceramic material predominantly over the airfoil 12 of the segment 10. Since the overspray byproduct 22 was removed between spraying stages, the SPS process now results in the fully coated segment 10 shown in FIG. 11 that is free of regions prone to erosion and spalling that would otherwise be attributable to the overspray byproduct 22, as represented in FIG. 11. Any overspray byproduct 22 resulting from a final spraying operation on assembly 10, using intermittent removal operations, will be over the top of the robust TBC 20 and will not significantly increase the thickness of the TBC 20, since the overspray byproduct 22 is generally thinner than the desired TBC coating. Further, any such overspray byproduct 22 is on the top of the robust TBC 20 as opposed to the previous, non-final spraying operations and will not contribute to erosion and spalling of the TBC 20 that has been deposited utilizing the robust process described in this invention.

Figure 1:
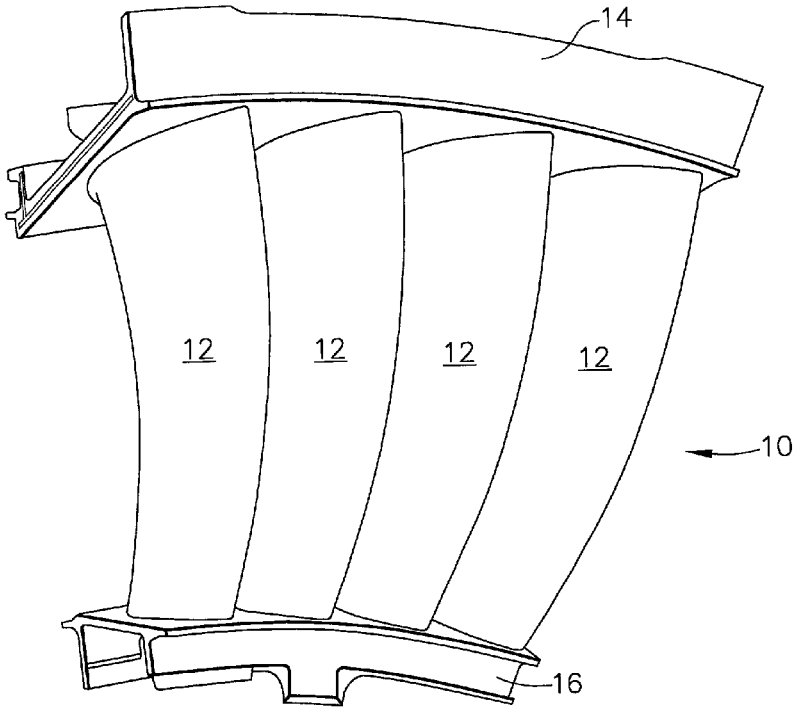
FIG. 1 (Prior Art)
FIG. 1 represents a vane segment comprising several vane airfoils.

Several experiments were conducted to confirm the advantages of the process and bring out the process details. In a first experiment, a vane assembly was sprayed with a ceramic material. Examples of suitable ceramic materials include yttria-stabilized zirconia (YSZ), which belongs to a class of materials that show erosion resistance and resistance to thermal spalling. Referring to FIG. 1, fifteen spray passes on the outer band 14 a segment of the assembly 13 were performed using suitable settings on the spray apparatus. Next, fifteen passes were performed on the inner band 16 of the segment 10 with different settings for the spray apparatus as needed. Finally, ten passes were made on the airfoil 12, again with suitable settings. The final passes over the airfoil 12 were performed at an angle approximately normal to the surface of the airfoil 12 and were shorter in length than the previous passes over the outer and inner bands 14 and 16, respectively. Examination of the vane segment at intermediate stages of the spray process revealed accumulation of the overspray byproduct along the inner bands 16. Regions of erosion and spallation occurred due to overspray byproduct build up, and the test methods typically employed revealed regions of erosion and spallation which occurred due to the overspray byproduct build up. This investigation evidenced the detrimental effect of overspray byproduct on the efficiency of a TBC, when no attempt was made to prevent the overspray byproduct formation or to remove the overspray byproduct intermittently in the process. This deleterious effect of the overspray byproduct was confirmed by conducting more experiments in which the TBC deposition process was performed on different segments of different vane assemblies without an intermittent overspray removal steps.

In another experiment, a segment of a vane assembly was sprayed according to the same spraying routine used in the first experiment. However, dry ice entrained in compressed air was used as a removal agent and was blasted over the inner band at a pressure of about 60 psi (about 415 kPa) to remove overspray byproduct after the spraying passes of the outer band. Unlike in previous experiments where no attempt was made to remove the overspray byproduct, the center of the airfoil of the segment exhibited a clean region relatively free of the overspray byproduct. The test segment was then fully coated utilizing intermittent steps for removal of undesired overspray byproduct. Tests conducted to verify the erosion resistance and spalling resistance of the TBC deposited integrating the overspray byproduct removal method into the process showed superior performance over the segments where no attempt was made to remove the overspray byproduct.

From these investigations, it was concluded that by following spraying stages of an SPS process with intermediate steps of removal operation utilizing dry ice, an overspray byproduct can be successfully removed.

By segmenting the spray routine and coating only a section of the segment 10 (such as the outer band 16 and fillet) at one time, then removing the overspray byproduct 22 with dry ice, the SPS process produces an improved microstructure of the TBC 20 and thus a more erosion-resistant coating. Furthermore, the removal operation may be implemented in-situ without having to stop the spray process, so that it does not adversely affect cycle time of the SPS process. It should be noted further that spray processes other than SPS can lend themselves to the described methods of intermedially removing the overspray byproduct 22. Since the function of the dry ice is providing an impact that is optimized for removing the overspray without affecting the integrity of the coating in other areas and the surface characteristics of the uncoated surfaces, other removal agents can include, for example, water jet, compressed air, and fine abrasive particles of an oxide, for example, aluminum oxide, entrained in a gaseous medium.

It should be noted that for effective removal of the overspray byproduct 22, the removal agent should be forceful and/or abrasive enough to remove the overspray byproduct 22 yet gentle enough not to disturb any metallic bond coat present on the surfaces to be coated and any surface conditioning performed on the bond coat to prepare its surfaces for TBC deposition. Accordingly, process parameters, such as pressure for the compressed air or dry ice entrained in air, and particle sizes where applicable, should be carefully chosen to effect the desired results. For example, when alumina particles are used as abrasive removal agent, a preferred average particle size is in the range of 150-200 micrometers. Further, the removal agent itself should be easily removable. In the case of compressed air and water jet, removal of the removal agent itself is automatic. In the case of air or other gaseous media containing abrasive particles, such as aluminum oxide particles, a subsequent step of removing any remaining particles may be necessary. It is important that no extraneous ingredients or other contaminants are introduced into the final TBC 20 as result of the process steps involved in the removal of the overspray byproduct 22.

Figure 2:
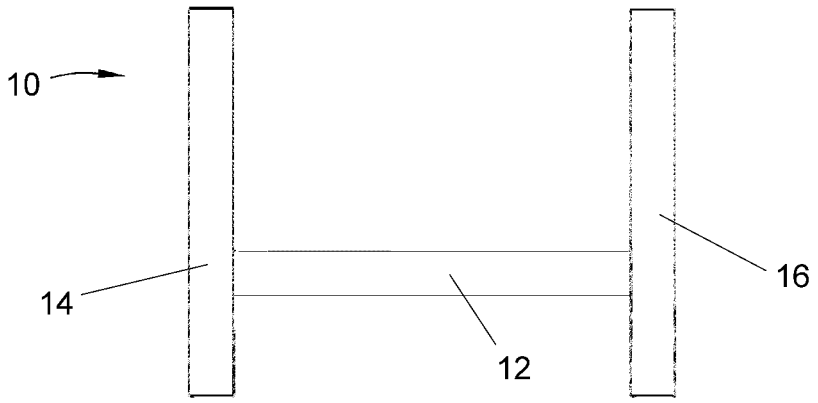
FIG. 2 (Prior Art)
FIG. 2 schematically represents a side view of a vane segment.

In the example of coating a segment of a vane assembly it can be seen from FIG. 2, that the segment defines surfaces lying in multiple planes that are transverse to each other. Hence, the areas to be coated with TBC are not coplanar. A ceramic coating can be deposited on a single surface of the vane assembly and, in a later step of the coating process, a ceramic coating can be deposited on a surface transverse to the previous surface. Further, the coating can be deposited simultaneously on transverse surfaces of the vane assembly. By judicious control of the process parameters, including the angle at which the torch 18 is directed at a segment to be coated, areas of deposition for the ceramic material and overspray byproduct can be controlled, leading to deposition of the TBC 20 on surfaces lying in a single plane of the vane assembly or simultaneously on surfaces transverse to each other, followed by removal of the overspray byproduct 22. In developing a process for depositing the TBC 20 with intermittent removal of the overspray byproduct 22, the torch 18 and the byproduct removal apparatus 26 as represented in FIGS. 6 and 7, respectively, it is foreseeable that one could integrate the torch 18 and apparatus 26 into a single apparatus.

While the invention has been described in terms of a specific embodiment, it is apparent that other forms could be adopted by one skilled in the art. For example, the system could differ in appearance and construction from the embodiment shown in the Figures, the functions of each component of the system could be performed by components of different construction but capable of a similar (though not necessarily equivalent) function, processing parameters such as temperatures and durations could be modified, and appropriate materials and/or components could be substituted for those noted. Accordingly, it should be understood that the invention is not limited to the specific embodiment illustrated in the Figures. Therefore, the scope of the invention is to be limited only by the following claims.

The invention claimed is:

1. A method of depositing a ceramic coating onto at least a portion of a vane assembly, the vane assembly comprising an airfoil connected to an outer band and an inner band, the method comprising:

depositing the ceramic coating on a first region of the vane assembly and simultaneously depositing an overspray byproduct on a second region of the vane assembly, wherein the first region comprises a first portion of the airfoil and at least a portion of the outer band, and the second region comprises a second portion of the airfoil and at least a portion of the inner band applying a removal agent to the second region of the vane assembly that has the overspray byproduct thereon to remove the overspray byproduct from the second region; and then depositing the ceramic coating on the second region of the vane assembly and simultaneously depositing the overspray byproduct on the first region of the vane assembly.

2. The method according to claim 1, wherein the depositing process is a suspension spray process.

3. The method according to claim 1, wherein the removal agent is chosen from the group consisting of dry ice entrained in a gaseous medium, compressed air, and abrasive particles of a solid material entrained in a gaseous medium.

4. The method according to claim 3, wherein the removal agent comprises the abrasive particles and the solid material is aluminum oxide.

5. The method in according to claim 4, wherein the aluminum oxide particles have an average size in a range of 150-200 micrometers.

6. The method according to claim 1, wherein the airfoil and the outer band define surfaces that are transverse to each other.

7. The method according to claim 6, wherein the airfoil and the inner band further define surfaces that are transverse to each other.

8. The method according to claim 1, wherein the removal agent is dry ice entrained in a gaseous medium.

* * * * *